US005993548A

United States Patent [19]

Madrzak et al.

[11] Patent Number: 5,993,548

[45] Date of Patent: Nov. 30, 1999

[54] FIBER WEB PROCESSING MACHINE HAVING A SPREADING DEVICE WITH A SUPPORT BEAM

[75] Inventors: Zygmunt Madrzak, Heidenheim; Manfred Ueberschär, Nattheim, both of Germany

[73] Assignee: Voith Sulzer Papiermaschinen GmbH, Heidenheim, Germany

[21] Appl. No.: 08/773,618

[22] Filed: Dec. 30, 1996

[30] Foreign Application Priority Data

Jan. 2, 1996 [DE] Germany ..... 296 00 016

[51] Int. Cl.[6] ..... B05C 11/02

[52] U.S. Cl. ..... 118/123; 118/413; 118/261

[58] Field of Search ..... 118/413, 414, 118/261, 262, 117, 122, 123, 126; 162/272, 199; 15/256.5, 256.51; 101/157, 169, 365; 248/309.1

[56] References Cited

U.S. PATENT DOCUMENTS

| | | | |
|---|---|---|---|
| 2,428,113 | 9/1947 | Grupe | 118/261 |
| 2,704,026 | 3/1955 | Rogge et al. . | |
| 3,803,665 | 4/1974 | Winterburn et al. | 118/126 |
| 4,520,049 | 5/1985 | Nakanishe | 118/413 |
| 4,899,687 | 2/1990 | Sommer et al. | 118/126 |
| 5,070,783 | 12/1991 | Irekon . | |
| 5,439,520 | 8/1995 | Reich | 118/410 |

*Primary Examiner*—Brenda A. Lamb
*Attorney, Agent, or Firm*—Taylor & Associates, P.C.

[57] ABSTRACT

The invention is directed to a machine for processing a fiber web. The machine includes a spreading device with a width. The spreading device is configured for applying a liquid or pasty medium onto the fiber web, or finely controlling an amount of the liquid or pasty medium on the fiber web. A support beam associated with the spreading device has opposing ends and a length which extends across the width of the spreading device. Two support elements are engaged with the support beam for holding the support beam in place. The two support elements are spaced along the length of the support beam, with each support element being located at a distance from a respective end of the support beam.

13 Claims, 1 Drawing Sheet

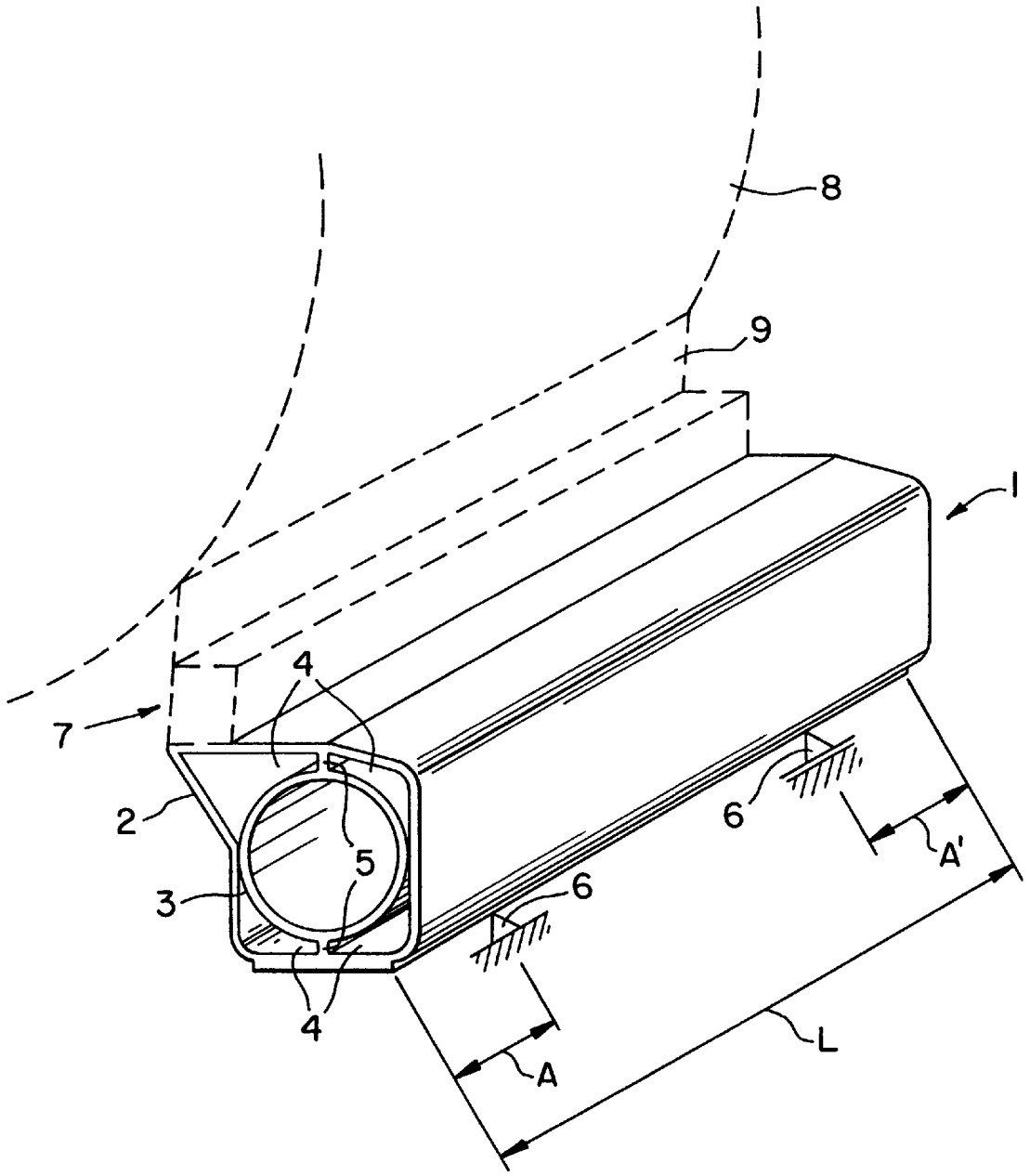
8
9
1
4
7
2
5
3
6
6
A'
4
A
L

FIBER WEB PROCESSING MACHINE HAVING A SPREADING DEVICE WITH A SUPPORT BEAM

BACKGROUND OF THE INVENTION

1. Field of the Invention

The present invention relates to a support beam for a spreading device for directly or indirectly spreading a liquid or pasty substance onto a running layer of either paper or cardboard (or carton), or to a support beam for a spreading device for accurately controlling an amount of a liquid or pasty substance that has already been applied onto a running layer of paper or cardboard (or carton).

2. Description of the Related Art

Support beams for spreading devices as described above are known in many variations. The spreading devices are mounted onto a support beam-structure and are equipped either for directly or indirectly spreading a liquid or pasty substance onto a running layer of paper or cardboard (or carton). The spreading devices may also be used to accurately control the amount of a liquid or pasty substance which has been previously applied onto a running layer of paper or cardboard (or carton).

In the first case (i.e., a spreading device for directly or indirectly spreading a liquid or pasty substance), the application of the spreading medium occurs through a pressure chamber with a wiping element, an open jet nozzle or another already known, comparable spreading mechanism. The so called direct application occurs in such a way that the spreading substance is directly applied onto the running layer which itself is supported by a counter roller. The indirect application on the other hand occurs in such a way that the spreading medium is first applied onto a spreading roller before it is transferred from its surface onto the running layer.

In the second case (i.e., a spreading device for finely controlling the amount of the spreading substance), a wiping element or one of a number similar known device are intended to perform fine adjustments to the amount of a liquid or pasty substance applied onto a running layer of paper or cardboard.

In commonly known constructions, the support beam is generally supported at two locations at the respective far ends of the beam structure. The problems that result out of this support method are that the support beam tends to bend, and, in addition, that is sensitive to very low resonance frequencies which can be created by vibrations in the base of the machinery or by any sort of vibrations that may travel through the foundation of the building.

SUMMARY OF THE INVENTION

The present invention provides a support beam for use with a spreading device which is less subject to bending and which has an increased resonance frequency.

The invention prescribes specific locations to support the support beam which reduce the amount of bending that the structure is subjected to, compared to commonly used structures of equal section size and wall thickness. Furthermore, a support beam according to the present invention increases the resonance frequency of the structure compared to structures of commonly used configurations. This separates the resonance frequency of the support beam from the frequencies of vibrations that occur, for example, in the base of the machinery or in the foundation of the building. This effectively prevents the occurrence of sympathetic vibrations in the support beam. The increased resonance frequency of the support beam also allows greater freedom in the design of the support beam.

The invention comprises, in one form thereof, a machine for processing a fiber web. The machine includes a spreading device with a width. The spreading device is configured for applying a liquid or pasty medium onto the fiber web, or finely controlling an amount of the liquid or pasty medium on the fiber web. A support beam associated with the spreading device has opposing ends and a length which extends across the width of the spreading device. Two support elements are engaged with the support beam for holding the support beam in place. The two support elements are spaced along the length of the support beam, with each support element being located at a distance from a respective end of the support beam.

In one embodiment of the present invention, the locations of the support elements are symmetrical around the center of the support beam with respect to the longitudinal extension of the support beam. But if the spatial constraints of the machinery prohibit this configuration for the support elements, the invention prescribes other locations for the support elements which are asymmetrical around the center of the support beam with respect to the longitudinal extension of the support beam.

In another embodiment of the present invention, the distance between the two support locations and the adjacent end of the support beam is between 15% and 30% of the overall length of the support beam. The support locations can be chosen at equal distances to both ends of the support beam, thus giving a symmetrical configuration of the support locations, or the distances between the support locations to the respective ends of the support beam can be different from one another.

Yet another favorable embodiment of this invention utilizes a symmetrical support arrangement whereby the distance between the support elements and the respective ends of the support beam is approximately 25% of the overall length of the support beam. For further considerations for a minimum deflection of the support beam, another embodiment of this invention utilizes yet another symmetrical configuration of the support locations for the beam, each at about 22% of the length of the support beam away from its respective ends.

Another embodiment of the invention incorporates the inclusion of one of the commonly known "beam deflection adjustment devices." Beam deflection adjustment devices can be based on thermal, pneumatic or hydraulic concepts, but they may also work on magnetic, inductive or mechanical concepts. A practical solution consists in incorporating struts parallel to the support beam that apply compressive or tensile forces to prevent deflection of the support beam.

The present invention increases the resonance frequency of the support beam and reduces the required wall thickness of the support beam. In addition, the invention also reduces the requirements imposed on the beam deflection adjustment device compared to commonly used constructions. The invention permits use of a lighter beam deflection adjustment device since a support beam with a lesser wall thickness can be easier prevented from deflecting. The thinner walls of the support beam as well as the lighter beam deflection adjustment device both contribute to the overall weight reduction of the support beam structure. A support beam designed by the guidelines of this invention is therefore also less expensive. The cross section of the beam can be chosen according to the spatial constraints and the structural requirements of the device, i.e., its shape can be triangular, round, polygonal or any other desired shape.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawing, which shows a schematic, perspective view of one embodiment of a support beam of the present invention.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Referring now to the drawing, there is shown a support beam 1 including an exterior structure 2 with a closed-wall polygonal section. Located inside exterior structure 2 is a pipe-shaped interior structure 3 with a closed circular section which is entirely connected with exterior structure 2. Two additional walls 5 connect interior pipe structure 3 with exterior polygon structure 2. These walls 5 separate the space in-between the two structures 2 and 3 into four longitudinal chambers 4. The cross section of the structure can of course be shaped differently; for example, the interior structure 3 can be polygonal or the number of enclosed chambers 4 can be other than four. Support beam 1 rests on two support elements 6, one of which is at a fixed location while the other one is not fixed. Support elements 6 for the symmetrical configuration shown are located at equal distances A and A', respectively, away from the ends of the support beam towards the center of the beam. The ratio of the distances A and A', respectively, between the ends of the beam to the nearest support locations 6 and the overall length L of support beam 1 is within 15% and 30%. An asymmetrical configuration of support elements 6 (not shown) has a distance A from one end of the support beam to the nearest support location 6 which is different from the distance A' from the other end of the support beam to the other support location 6.

To counteract the deflection of the support beam the temperatures of liquid substances which flow through the separate chambers 4 are varied such that the thermal expansions caused by the different temperatures counteract the deflection of the beam caused by applied loads and/or its own weight. To counteract the deflection of the support beam one can also employ a mechanical beam deflection adjustment device using flexible pressure tubing, a concept which is already known from the patent document DE 39 25 517 C2.

For clarification, the dashed lines in the figure indicate a functional component 7 which is incorporated into support beam 1. Such a functional component 7 may be a spreading mechanism together with a wiping element, or, an open jet nozzle (not shown) for the direct or indirect application of the medium either onto the running layer of either paper or cardboard or onto a spreading roll 8 before it is indirectly transferred from the surface of roll 8 onto the running layer of paper or cardboard. The drawing shows an embodiment where the medium is applied with a blade 9.

Functional component 7 may also be a device for the final adjustment of the amount of medium applied to the layer with a blade 9 as the implement to perform some last fine adjustments to the amount of a liquid or pasty substance applied onto the running layer of paper or cardboard. It is also possible that blade 9 can be used to scrape impurities from the surface spreading roll 8 inside the paper machine.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a fiber web processing machine for one of applying a liquid or pasty medium onto a fiber web, and finely controlling an amount of the liquid or pasty medium on the fiber web, said fiber web processing machine comprising:

a spreading device associated with the web, said spreading device including a doctoring element and means for directly holding the doctoring element, said spreading device having a longitudinal extension, two longitudinal ends and a width, said spreading device configured for finely controlling an amount of the liquid or pasty medium on the fiber web;

a support beam directly attached to and directly carrying said spreading device, said support beam having opposing ends and a length which extends across the width of the spreading device, said support beam is hollow with multiple chambers; and two support elements engaged with said support beam for holding said support beam in place such that said support beam rests upon each said support element, said two support elements being spaced along said length of said support beam, said two support elements defining an axis extending therebetween which is aligned substantially parallel to said longitudinal extension of said spreading device, each said support element being located at a distance from a respective said end of said support beam and at a respective longitudinal position between said two longitudinal ends of said spreading device.

2. The fiber web processing machine of claim 1, wherein said support beam has a longitudinal center midway between said ends, and wherein said support elements are symmetrically located relative to said longitudinal center.

3. The fiber web processing machine of claim 1, wherein the fiber web comprises one of paper and cardboard.

4. The fiber web processing machine of claim 1, wherein each said support element is disposed below said support beam.

5. The fiber web processing machine of claim 4, wherein each said support element is located at a longitudinal distance from a respective one of said two longitudinal ends of said spreading device which is between approximately 15% and 30% of said width of said spreading device.

6. The fiber web processing machine of claim 4, wherein said spreading device has a longitudinal center midway between said two longitudinal ends, said support elements being asymmetrically located relative to said longitudinal center of said spreading device.

7. The fiber web processing machine of claim 1, wherein one said support element has a fixed location, an other said support element having a variable location.

8. The fiber web processing machine of claim 1, wherein each said support element is located at a longitudinal distance from a respective one of said two longitudinal ends of said spreading device which is approximately 22% of said width of said spreading device.

9. The fiber web processing machine of claim 1, wherein each said support element is located at a longitudinal distance from a respective one of said two longitudinal ends of said spreading device which is approximately 25% of said width of said spreading device.

10. In a fiber web processing machine for one of applying a liquid or pasty medium onto a fiber web, and finely controlling an amount of the liquid or pasty medium on the fiber web, said fiber web processing machine comprising:

a spreading device associated with the web, said spreading device including a doctoring element and means for directly holding the doctoring element, said spreading device having a longitudinal extension, two longitudinal ends and a width, said spreading device configured for finely controlling an amount of the liquid or pasty medium on the fiber web;

a support beam directly attached to and directly carrying said spreading device, said support beam having opposing ends and a length which extends across the width of the spreading device, said support beam is hollow with multiple chambers, said support beam having a longitudinal center midway between said ends; and two support elements engaged with said support beam for holding said support beam in place, said two support elements being spaced along said length of said support beam, said two support elements defining an axis extending therebetween which is aligned substantially parallel to said longitudinal extension of said spreading device, each said support element being located at a distance from a respective said end of said support beam and at a respective longitudinal position between said two longitudinal ends of said spreading device, said support elements being symmetrically located relative to said longitudinal center of said support beam, each said support element being located at a distance from said respective end of said support beam which is approximately 25% of said length of said support beam.

11. In a fiber web processing machine for one of applying a liquid or pasty medium onto a fiber web, and finely controlling an amount of the liquid or pasty medium on the fiber web, said fiber web processing machine comprising:

a spreading device associated with the web, said spreading device including a doctoring element and means for directly holding the doctoring element, said spreading device having a longitudinal extension, two longitudinal ends and a width, said spreading device configured for finely controlling an amount of the liquid or pasty medium on the fiber web;

a support beam directly attached to and directly carrying said spreading device, said support beam having opposing ends and a length which extends across the width of the spreading device, said support beam is hollow with multiple chambers, said support beam having a longitudinal center midway between said ends; and two support elements engaged with said support beam for holding said support beam in place, said two support elements being spaced along said length of said support beam, said two support elements defining an axis extending therebetween which is aligned substantially parallel to said longitudinal extension of said spreading device, each said support element being located at a distance from a respective said end of said support beam and at a respective longitudinal position between said two longitudinal ends of said spreading device, said support elements being symmetrically located relative to said longitudinal center of said support beam, each said support element being located at a distance from said respective end of said support beam which is approximately 22% of said length of said support beam.

12. In a fiber web processing machine for one of applying a liquid or pasty medium onto a fiber web, and finely controlling an amount of the liquid or pasty medium on the fiber web, said fiber web processing machine comprising:

a spreading device associated with the web, said spreading device including a doctoring element and means for directly holding the doctoring element, said spreading device having a longitudinal extension, two longitudinal ends and a width, said spreading device configured for finely controlling an amount of the liquid or pasty medium on the fiber web;

a support beam directly attached to and directly carrying said spreading device, said support beam having opposing ends and a length which extends across the width of the spreading device, said support beam is hollow with multiple chambers, said support beam having a longitudinal center midway between said ends; and two support elements engaged with said support beam for holding said support beam in place, said two support elements being spaced along said length of said support beam, said two support elements defining an axis extending therebetween which is aligned substantially parallel to said longitudinal extension of said spreading device, each said support element being located at a distance from a respective said end of said support beam and at a respective longitudinal position between said two longitudinal ends of said spreading device, said support elements being asymmetrically located relative to said longitudinal center.

13. In a fiber web processing machine for one of applying a liquid or pasty medium onto a fiber web, and finely controlling an amount of the liquid or pasty medium on the fiber web, said fiber web processing machine comprising:

a spreading device associated with the web, said spreading device including a doctoring element and means for directly holding the doctoring element, said spreading device having a longitudinal extension, two longitudinal ends and a width, said spreading device configured for finely controlling an amount of the liquid or pasty medium on the fiber web;

a support beam directly attached to and directly carrying said spreading device, said support beam having opposing ends and a length which extends across the width of the spreading device, said support beam is hollow with multiple chambers; and two support elements engaged with said support beam for holding said support beam in place, said two support elements being spaced along said length of said support beam, said two support elements defining an axis extending therebetween which is aligned substantially parallel to said longitudinal extension of said spreading device, each said support element being located at a distance from a respective said end of said support beam and at a respective longitudinal position between said two longitudinal ends of said spreading device, each said support element being located at a distance from said respective end of said support beam which is between approximately 15% and 30% of said length of said support beam.

* * * * *